US007407444B2

(12) United States Patent
Cera

(10) Patent No.: US 7,407,444 B2
(45) Date of Patent: Aug. 5, 2008

(54) METHOD FOR CUSHIONING THE GRIP OF A GOLF CLUB, AND APPARATUS FOR PRACTICING THE METHOD

(76) Inventor: David L. Cera, 156 Island Pl., Memphis, TN (US) 38103

( * ) Notice: Subject to any disclaimer, the term of this patent is extended or adjusted under 35 U.S.C. 154(b) by 0 days.

(21) Appl. No.: 11/231,685

(22) Filed: Sep. 21, 2005

(65) Prior Publication Data

US 2006/0205529 A1 Sep. 14, 2006

Related U.S. Application Data

(60) Provisional application No. 60/660,891, filed on Mar. 11, 2005.

(51) Int. Cl.
*A63B 53/14* (2006.01)

(52) U.S. Cl. ..... 473/300

(58) Field of Classification Search ..... 473/300–303, 473/550, 568, 520–521, 523; 74/756; 81/489; 16/430; 280/821
See application file for complete search history.

(56) References Cited

U.S. PATENT DOCUMENTS 584,220 A * 6/1897 Gunsaul ..... 74/551.9
2,954,697 A 10/1960 Geist
4,509,228 A * 4/1985 Landsberger ..... 16/426
5,193,246 A * 3/1993 Huang ..... 16/421
5,263,203 A 11/1993 Kraemer et al.
5,294,117 A 3/1994 Huang
5,355,552 A 10/1994 Huang
5,407,206 A 4/1995 Cohen
5,540,625 A 7/1996 Koch et al.
5,632,693 A 5/1997 Painter
5,692,265 A 12/1997 Dalury
5,803,821 A 9/1998 Lupinacci
5,813,921 A 9/1998 Huang
5,815,028 A 9/1998 Reynolds
5,816,933 A 10/1998 Huang
5,827,129 A 10/1998 Huang
5,846,145 A 12/1998 Tinlin
5,895,329 A 4/1999 Huang
5,897,448 A 4/1999 Chang
5,904,628 A 5/1999 Mackay, Jr. et al.
5,910,054 A 6/1999 Huang
6,148,482 A 11/2000 Maraman, Jr.
6,226,801 B1 5/2001 Alexander et al.

(Continued)

*Primary Examiner*—Stephen L. Blau
(74) *Attorney, Agent, or Firm*—Peter L. Brewer; Baker, Donelson, Bearman, Caldwell & Berkowitz, PC

(57) ABSTRACT

A method is provided for cushioning the grip of a striking instrument which generally includes the steps of providing a striking instrument having an elongated shaft, placing a pneumatically actuated cushioning apparatus over the distal end of the shaft, the pneumatically actuated cushioning apparatus having a bladder configured to surround the proximal end of the shaft along a desired length and a valve for receiving a volume of air; inserting the nozzle of a pump into the valve of the cushioning apparatus, and operating the pump in order to inject a volume of air into the bladder, thereby cushioning the grip of the striking instrument. Preferably, the striking instrument is a golf club. A cushioning apparatus is also provided, which includes an inner layer and an outer layer defining a bladder, and a valve for receiving air and delivering it into the bladder so that the grip may be pumped up.

6 Claims, 3 Drawing Sheets

U.S. PATENT DOCUMENTS

| | | | | |
|---|---|---|---|---|
| 6,279,637 | B2 | 8/2001 | Lenhof et al. | |
| 6,336,263 | B1 | 1/2002 | Weiss et al. | |
| RE37,702 | E | 5/2002 | Huang | |
| 6,401,321 | B2 | 6/2002 | Carey et al. | |
| 6,460,237 | B1 | 10/2002 | Tsiguloff | |
| 6,500,079 | B1 | 12/2002 | Tucker, Sr. | |
| 6,558,270 | B2 | 5/2003 | Kwitek | |
| 6,676,534 | B2 | 1/2004 | Huang | |
| 6,701,529 | B1 | 3/2004 | Rhoades et al. | |
| 6,815,028 | B2 | 11/2004 | Huang | |
| 6,821,218 | B2 | 11/2004 | Byrne et al. | |
| 6,832,413 | B1 | 12/2004 | Applewhite et al. | |
| 6,934,971 | B2 | 8/2005 | Ide et al. | |
| 2004/0248664 | A1* | 12/2004 | Billings | 473/300 |
| 2005/0043110 | A1* | 2/2005 | Lindsey | 473/300 |

* cited by examiner

METHOD FOR CUSHIONING THE GRIP OF A GOLF CLUB, AND APPARATUS FOR PRACTICING THE METHOD

STATEMENT OF RELATED APPLICATIONS

The present application is related to and claims priority to Provisional Patent Application Ser. No. 60/660,891, entitled "Method for Cushioning the Grip of a Striking Instrument, and Apparatus for Practicing the Method." That application has a filing date at least as early as Apr. 5, 2005. Both the Provisional Patent Application submitted Mar. 11, 2005 and the drawings tendered at least as of Apr. 5, 2005 are incorporated herein by reference, in their entireties.

BACKGROUND OF THE INVENTION

1. Field of the Invention

The present invention generally relates to grips. More particularly, the present invention relates to a pneumatically cushioned grip for a golf club or other striking implement.

2. Description of the Related Art

Shock generated by a striking instrument impacting an object can adversely affect muscle tissue and arm joints. For example, shock generated when the head of a golf club strikes a golf ball generates a high frequency, short duration energy wave that can adversely affect muscle tissue and joints in and around the fingers, wrists, elbows and shoulders of the user. The energy generated by such shock is sometimes referred to as "impact shock."

Tight grasping of a golf club grip causes impact shock to the muscle tissue and joints of golfers. Early golf club grips were generally made by wrapping a leather strap about the proximal end of the golf club. The leather grips provided little shock resistance or cushioning. Subsequently, molded rubber materials were provided for golf grips. More recently, golf club grips have been fabricated from a synthetic rubber made to look like leather. While these materials have greater shock absorbency than leather, rubber and synthetic rubber can also degrade over time and become hard, thus losing their shock absorbing ability. The problems associated with hard grips become even more pronounced when a golfer strikes hundreds of golf balls at a driving range.

Recent attempts have been made to improve golfer comfort by providing conformable grips. In one instance, a grip has included a shell which is shaped and dimensioned to fit about the proximal end of a golf club shaft. The shell may be constructed from a variety of soft elastomers such as rubber or synthetic rubber-like materials. The shell receives a viscoelastic surface which is gripped by the user. The viscoelastic hand surface is a viscoelastic solid-phase polymer material such as styrenic thermoplastic elastomer; alternatively, it may be a gelatinous material. In one arrangement, the hand surface is fabricated from KEVLAR-reinforced thermoplastics.

In another instance, a golf club grip has been provided having a polyurethane layer bonded to a felt layer. The outer polyurethane layer may be embossed with a friction-enhancing pattern.

While the above developments represent an advance in the cushioning of golf club grips, these materials can also degrade over time or become worn. In such instances, the conformable nature of the grips is reduced.

Therefore, there is a need for a gripping apparatus that provides a greater cushion for golfers. Further, there is a need for a grip that is pneumatic, thereby providing an air cushion for the golfer around the shaft of the club. Further, there is a need for a grip having a degree of cushioning that is selectable and renewable. Further, there is a need for a method of cushioning the grip of a striking instrument such as a golf club that includes pneumatic actuation.

SUMMARY OF THE INVENTION

A method is provided for cushioning the grip of a striking instrument. In one aspect, the method includes the steps of providing a striking instrument having an elongated shaft, the elongated shaft having a proximal end to be grasped by a user; placing a pneumatically actuated cushioning apparatus over the distal end of the shaft, the pneumatically actuated cushioning apparatus comprising a single elongated bladder configured to surround the proximal end of the shaft along a desired length, and a valve for receiving air; inserting the nozzle of a pump into the valve of the pneumatically actuated cushioning apparatus; and, operating the pump in order to inject a volume of air into the bladder, thereby cushioning the grip of the striking instrument.

The striking instrument may be any of a number of hand-operated implements. Non-exclusive examples include a hand tool, a racquet and a golf club. The golf club may be any club from a driver to any iron to a putter.

A cushioning apparatus for a striking instrument is also provided. Preferably, the striking instrument is a golf club. The cushioning apparatus, in one aspect, includes an elongated inner layer having an upper end and a lower end; an elongated outer layer also having an upper end and a lower end, with the lower end of the outer layer being sealed with the lower end of the inner layer such that the bladder is defined between the inner layer and the outer layer; and a valve, the valve being configured to receive the nozzle of a pump so as to selectively place the bladder in fluid communication with the nozzle. In one embodiment, the inner layer and the outer layer of the cushioning apparatus each defines a thin skin. In this arrangement, the apparatus will receive a conventional outer grip (such as a golf club grip) over the outer skin before the cushioning apparatus is inflated.

In an alternate embodiment, the outer layer defines a golf grip to be engaged by the hands of a golfer. This means that the lower ends of the outer golf grip and the inner layer are sealed to contain air. This grip may be original equipment from the manufacturer. Alternatively, a pre-existing, conventional golf club grip is removed from the shaft of the golf club before the pneumatically actuated cushioning apparatus is placed over the distal end of the shaft. In either instance, a nozzle from a pump is inserted into the valve to "air up" the grip.

An improved golf club is also provided. In one embodiment the golf club includes an elongated shaft having a distal end and a proximal end, the proximal end to be grasped by a user; a head at the distal end of the shaft; a butt at the end of the proximal end of the shaft, the butt having a through-opening; and a pneumatically actuated cushioning apparatus placed over the distal end of the shaft, the pneumatically actuated cushioning apparatus comprising a single elongated bladder configured to surround the proximal end of the shaft along a desired length, and a valve for receiving a volume of air, the valve being aligned with the through-opening in the butt. The cushioning apparatus preferably further includes an elongated inner layer having an upper end and a lower end; an elongated outer layer also having an upper and a lower end, with the lower end of the outer layer being sealed with the lower end of the inner layer such that the bladder is defined between the inner layer and the outer layer; and the valve, with the valve being configured to receive a nozzle of a pump so as to selectively place the bladder in fluid communication with the nozzle of the pump.

In one embodiment, the inner layer and the outer layer each defines a thin skin. Alternatively, the outer layer defines a golf grip to be engaged by the hands of a golfer.

In another aspect of the invention, a method of playing golf is provided. The method includes the steps of taking a bag of golf clubs to a golf playing area; selecting a golf club from a bag in which the selected golf club has a cushioning apparatus as described above; inserting a nozzle of a pump into the valve of the pneumatically actuated cushioning apparatus; and operating the pump in order to inject a volume of air into the bladder, thereby cushioning the grip of the selected golf club. An additional step of inserting a golf tee into the through-opening of the butt so as to release at least some of the air from the bladder may be employed.

BRIEF DESCRIPTION OF THE DRAWINGS

So that the manner in which the above recited features of the present invention can be better understood, certain drawings or flow charts are appended hereto. It is to be noted, however, that the appended drawings illustrate only selected embodiments of the inventions and are therefore not to be considered limiting of scope, for the inventions may admit to other equally effective embodiments and applications.

DETAILED DESCRIPTION

Definitions

As used herein, the term "conventional golf club grip" refers to any grip for use as a golf club grip.

The term "head" refers to any striking object. Non-limiting examples include a string bed for a tennis racquet or racquetball racquet, a hammer head, or a blade or driver head at the end of a golf club.

The term "golf playing area" refers to any place where a golf club is used. Non-limiting examples include a driving range, a golf course and a golfing instructional facility.

Description of Specific Embodiments

Figure 1:
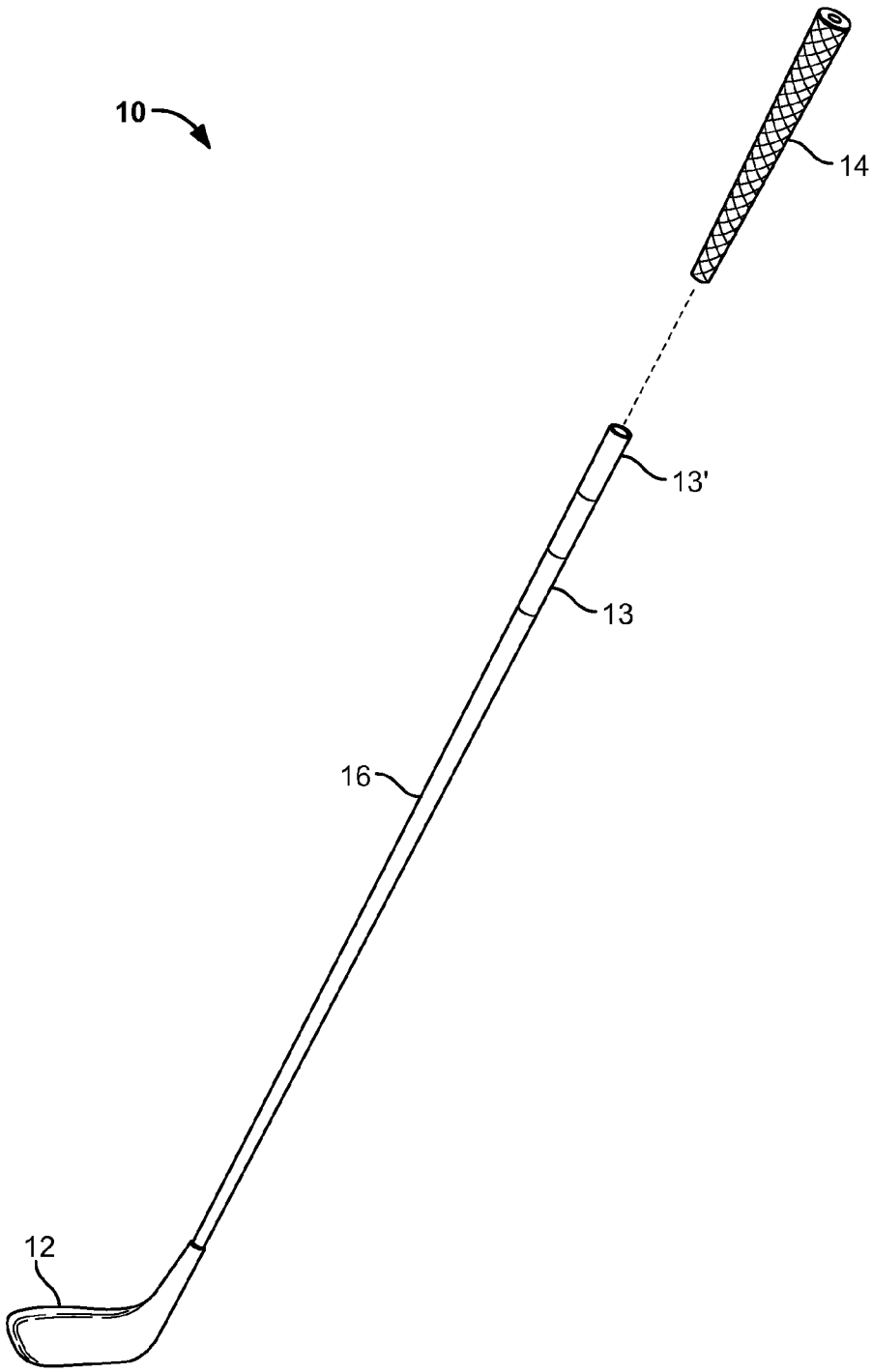
FIG. 1 (Prior Art)
FIG. 1 presents a perspective view of a striking instrument. The striking instrument depicted is a known golf club. In this view, the grip is exploded away from the shaft of the golf club.

FIG. 1 presents a known golf club 10. The golf club 10 has a head 12 for striking a golf ball (not shown). The golf club 10 further has an elongated shaft 16. The head 12 is connected to the shaft 16 at a distal end. Finally, the golf club 10 has a removable grip 14. The grip 14 is shown exploded away from the shaft 16. The grip 14 is configured to be slidably received over a proximal end 13 of the shaft 16. The grip 14 may be any conventional golf club grip as described above.

It is understood at the outset that the golf club 10 is intended to be an example of a striking instrument. Such an instrument may alternatively be a tennis racquet, a hammer or any other striking instrument having an elongated shaft and a striking head. In the context of golf clubs, the golf club 10 is again merely illustrative; the club may also be a putter, a wedge, any type of "wood" or any type of "iron."

Figure 2:
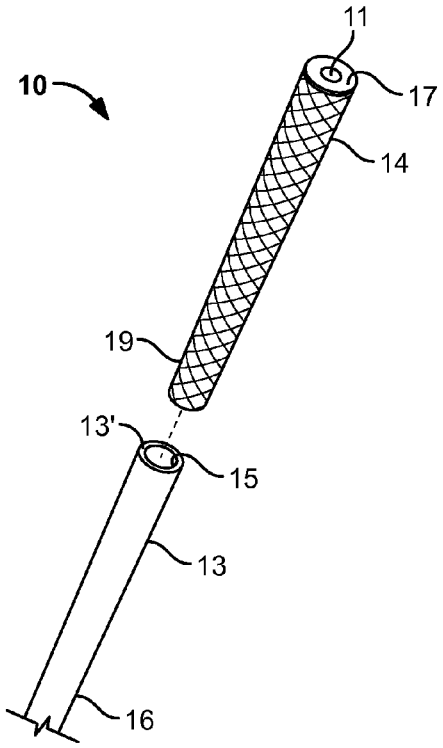
FIG. 2 (Prior Art)
FIG. 2 presents an enlarged view of the prior art golf club of FIG. 1. In this view, the grip is again exploded away from the shaft.

FIG. 2 shows an enlarged perspective view of the shaft 16 and grip 14 of the exemplary golf club 10 of FIG. 1. The proximal end 13 of the shaft 16 is more clearly seen. It is also noted that the shaft 16 defines a hollow body having a bore 15 therealong. A distal end 19 of the grip 14 elastically fits over the proximal end 13 of the hollow shaft 16.

Also visible in FIG. 2 is a proximal end of the grip 14. The proximal end defines a butt 17. The butt 17 may aid in securing layers of the grip 14 and also serves an aesthetic purpose and a safety purpose in covering the end 13 of the shaft 16. The butt 17 may be integral to the grip 14. The grip 14 includes a through opening 11 through the butt 17. The through opening provides fluid communication into the bore 15 of the hollow shaft 16.

In practice, golf club grips may be placed on the proximal end 13 of the golf club shaft 16 by the club manufacturer. Such "factory" grips may be replaced by the consumer before use or after use. The golf club shaft 16 may be manually wrapped with a double-sided tape at its proximal end 13. A solvent or lubricant is sprayed into the hollow interior of the grip 14. The solvent or lubricant allows the grip 14 to be placed over the shaft 16 without deterring from the adhesiveness of the tape. The grip 14 is urged over the shaft 16 until the closed proximal end of the grip 14 is flush with the proximal or butt end 13 of the shaft 16. The solvent eventually evaporates allowing for the tape to adhere to the surface of the hollow interior of the grip 14. In some instances, the adhesive is heat-activated, with heat being applied by a hot air gun, a torch or even a cigarette lighter.

Once a grip 14 is placed over a shaft 16, the golfer is left with no cushion except as might be inherent in the material of the grip. Even more recent grip materials do not completely eliminate impact shock. This is of particular concern for senior golfers and for golfers prone to joint or muscle tissue injuries. Therefore, and as noted above, there is a need for a grip that provides a greater cushion for golfers. Further, there is a need for a grip that is pneumatic, thereby providing an air cushion for the golfer around the shaft of the club. Further, there is a need for a grip having a degree of cushioning that is selectable and renewable. Further, there is a need for a method of providing a cushioned grip onto the shaft of a striking instrument such as a golf club that employs a pneumatically actuated bladder."

Figure 3:
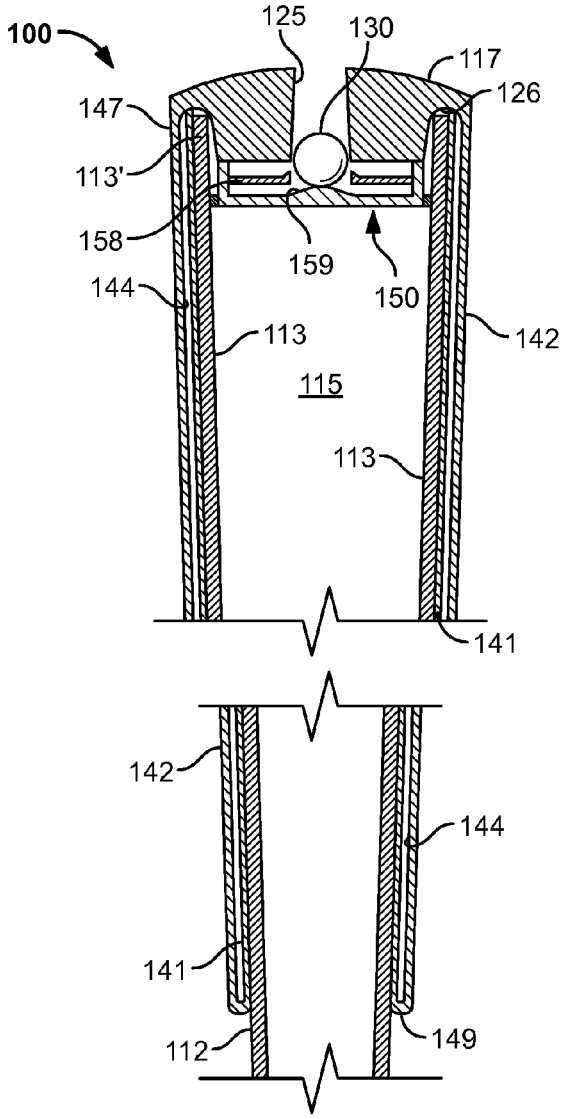
FIG. 3 presents a side cross-sectional view of a cushioned grip of the present invention, in one embodiment.

FIG. 3 provides a cross-sectional view of a cushioned grip 100 of the present invention, in one embodiment. The grip 100 is shown disposed around an elongated shaft 112, such as a golf club shaft. The upper end of the shaft is shown at 113. The proximal tip is shown at 113'.

The grip first comprises an outer sleeve 142. The outer sleeve 142 defines an elongated, pliable body configured to elastically slide over the shaft 112. In the embodiment shown, the outer sleeve 142 represents a golf club grip to be engaged by a golfer. The sleeve 142 has a lower (distal) end 149 and an upper (proximal) end 147.

The grip also includes an inner layer 141. The inner layer 141 defines a pliable thin skin designed to be placed around the shaft 112 when the grip 100 is installed. At the same time, an annular region 144 is formed between the outer sleeve 142 and the inner skin 141. This annular area is sealed off at the lower end 149 of the sleeve 142; however, the upper end 147 of the outer sleeve 142 is not sealed to the inner skin 141. In this way, the annular area 144 defines a bladder. As will be described below, the bladder 144 receives air in order to create a greater cushion for the grip 100.

The grip 100 next includes a butt 117. The butt is at the proximal end of the shaft 112. Preferably, the butt 117 is integral to the outer sleeve 142. Alternatively, the butt 117 is a separate member from the outer sleeve 142, but provides a sealed connection so as to hold air when the bladder 144 is filled.

The butt 117 includes a through opening 125. The through opening 125 provides fluid communication to a valve 150. The valve 150 may be any type of one-way valve. In the embodiment shown in FIG. 3, the valve 150 is a ball-and-seat valve. A ball 130 and a seat 159 for the valve 150 are seen in FIG. 3.

Figure 4:
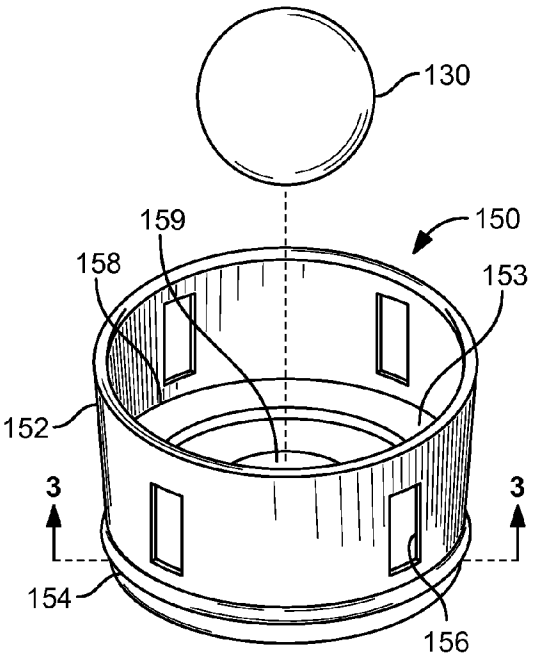
FIG. 4 presents a perspective view of a valve as might be used with the cushioned grip of FIG. 3, in one embodiment. A ball is shown exploded off of a seat in the valve.

FIG. 4 presents a perspective view of the valve 150 of FIG. 3. The ball 130 is seen exploded away from the seat 159. As shown more fully in FIG. 4, the valve 150 includes a cylindrical body 152 having has one or more air passages 156. The body 152 is affixed to the bottom of the butt 117. An inner surface of the body 152 contains a ball-retention ring 158. The ring 158 helps to position the ball 130 over the seat 159 during assembly and use. The body 152 also contains a seal member 154 around its outer diameter. The seal member 154 serves to provide a fluid seal between the outer surface of the body 152 and the inner diameter of the shaft 112 upon installation.

During installation, the outer sleeve 142 is urged down over the shaft 112. Preferably, the butt 117 and connected valve 150 are secured to the outer sleeve 142. This way, the outer sleeve 142 will be in place when the butt 117 contacts the proximal tip 113' of the shaft 112. Alternatively, the butt 117 and connected valve 150 are separate from the outer sleeve 142, and are inserted into the tip 113' of the shaft 112 once the outer sleeve 142 is in place.

As the outer sleeve 142 is urged down over the shaft 112, the inner sleeve 141 is also pulled down over the shaft 112. Preferably, stitching (not shown) is provided to connect the inner sleeve 141 to the outer sleeve 142 in spaced-apart locations to ensure that the shape of the inner sleeve 141 is maintained along the shaft 112 and does not become crimped. Such incremental stitching further helps to maintain the position of the inner sleeve 141 and the shape of the bladder 144 when air is later urged into the bladder 144. It is understood that such stitching cannot be circumferential at any point along the inner sleeve 141 to allow the longitudinal passage of air into the bladder 144.

When the outer sleeve 142 is fully received over the shaft 112, the butt 117 will contact the top end 113' of the shaft 112. Spacers are preferably provided under the butt 117 to preserve an air passage over the shaft 112. One spacer is seen in FIG. 3 at 126.

As the butt 117 contacts the end 113' of the shaft 112, the seat 159 and surrounding seal ring 154 are received within the bore 115 of the shaft 112. The seal ring 154 again provides a sealed relationship between the valve 150 and the surrounding shaft 112 when the grip 100 is inserted onto the shaft 112. Air may then be urged through the through opening 125 of the butt 117. As additional pressure is applied through the through opening 125, the ball 130 is urged downwardly against the seat 159. The seat 159 is fabricated from a deformable material to permit limited downward movement of the seat 159. Alternatively, a biasing member such as a spring (not shown) may be placed below the ball 130 to bias the ball 130 in an upward position. In one aspect, and as shown in FIGS. 3 and 4, the seat 159 may include a raised portion. This helps to further raise the ball 130 up to the through-opening 125 when air is not being forced downwardly into the valve 150.

As air is forced across the ball 130 and into the valve 150, the air passes through the air passages 156 in the cylindrical body 152. From there, air travels under the butt 117, through the spacers 126, over and around the proximal end 113' of the shaft 112, and into the bladder 144. As noted, the lower seal end 149 of the outer sleeve 142 retains air pressure in the bladder 144 as air is driven into the valve 150.

The body 152 of the valve 150 is configured to provide a close and frictional fit within the inner diameter of the shaft 112. Because the shaft 112 also defines an inverted frusto-conical body, downward movement of the valve 150 during application of air pressure helps prevent the valve 150 from moving downward through the shaft 112. The external seal ring 154 further aids in preventing downward slippage of the valve body 152. The frusto-conical cross-section also acts to further seal the seat 150 and external seal ring 154 when air is moved across the ball 130.

Once air pressure is no longer being urged into the through-opening 125, air pressure residing within the bladder 144 will act upwardly against the ball 130. This will cause the ball to seat upwardly in the through-opening 125 of the butt 117. To this end, the through-opening 125 in the butt 117 defines inwardly sloped walls to assist in seating. An optional seating ring (not shown) may also be employed within the through-opening 125 for seating the ball 130.

At some point, the golfer may desire to release air pressure from the bladder 144. This would be particularly true when the golfer desires to replace the grip 100. In order to release air pressure from the bladder 144, the golfer may insert a golf tee or other pointed object (even the needle of the pump) into the through-opening 125 of the butt 117. This will cause the ball 130 to unseat against the through-opening 125, thereby releasing air from the bladder 144.

In the cushioned grip 100 of FIG. 3, the bladder 144 is integral with the grip 100. In this respect, the outer sleeve 142 and the inner skin 141 are connected at the lower end 149. However, a separate membrane may be utilized as the bladder.

Figure 5:
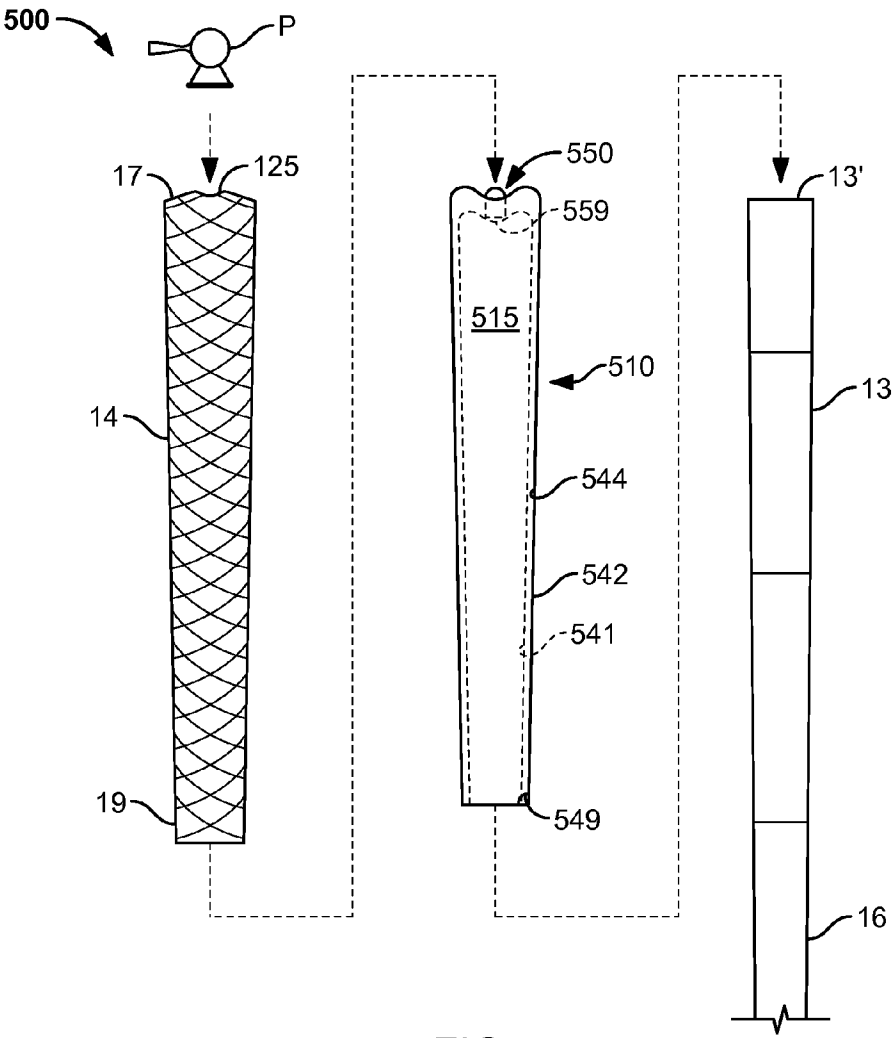
FIG. 5 presents an alternate arrangement for a cushioned grip of the present invention.

FIG. 5 presents an alternate arrangement for a cushioned grip 510 of the present invention In this side view, a grip 14 and an inflatable apparatus 510 are shown separately and in exploded-apart relation. The grip 14 has a butt 17, a bottom end 19 and an elongated hollow inner bore (not seen). The butt 17 includes a through-opening 125.

The grip 14 is a conventional golf grip that would otherwise be placed over the shaft of a golf club. A shaft is shown in FIG. 5 at 16. The shaft 16 is likewise exploded apart from the inflatable apparatus 510.

Referring to the inflatable apparatus 510, the apparatus 510 defines a thin inner skin 541 and a thin outer skin 544 that together form a circumferential chamber, or bladder 542. The inner skin, or inner layer 541, is shown in broken lines to indicate its position within the inflatable apparatus 510. The inner 541 and outer 544 layers are in sealed connection at a lower end 549. An inner bore 515 is defined between the opposing inner layers 541. The inner bore 515 is open at the bottom to slidably receive the shaft 16 of a golf club.

The inner 541 and outer 544 layers are in fluid communication at a top 559 of the inflatable apparatus 510. The top of the apparatus 510 also includes a small valve 550. The valve 550 is preferably of the diaphragm type; though it may be of any type.

In operation, the bottom 549 of the inflatable apparatus 510 is placed over the top, or proximal end 13, of the shaft 16. The inflatable apparatus 510 is preferable pulled down over the shaft 16 until the top 559 of the apparatus 510 is adjacent the tip 13' of the proximal end 13 of the shaft 16. Thereafter, the grip 14 is slipped over the separate inflatable apparatus 510. Stated another way, the proximal end 13 and surrounding inflatable apparatus 510 are concentrically received within the bore of the grip 14. The grip 14 is pulled down over the shaft 16 until the butt 17 engages the top 559 of the inflatable apparatus 510. The through-opening 125 and the valve 550 will then be aligned and ready to jointly receive a pump. At the same time, the valve 550 is preferably received at least in part into the hollow inner bore of the shaft 16 at the tip 13'.

FIG. 5 also shows a pump. The pump is shown schematically at P. The pump P will include a nozzle that is inserted into the through-opening 125 and the valve 550. The pump P is then actuated in order to push air into the bladder 542. Inflation of the inflatable apparatus 510 will create a cushioning apparatus 500 by which a golfer's comfort is improved.

The disclosed grips 100, 500 reduce hand fatigue associated with gripping a hard hand surface. By providing a pneumatically adjustable grip, substantial shock absorption is provided. It is understood that any pump can be used in order to "air up" the cushioned grips 100, 500. Preferably, the pump will be small enough to be transported in a golf bag. An example would be the type of hand activated pump used for airing cushions within a football helmet. The through-opening 125 would be sized to receive a nozzle of such a pump. Other types of pump and valve arrangements may be used, and the present inventions are not restricted as to the type of pump or valve used. For example, the valve might be a diaphragm-type valve such as is used for water flotation devices.

It should again be understood that the disclosed embodiments are merely exemplary of the inventions, which may be embodied in various forms. Therefore, the details disclosed herein are not to be interpreted as limiting, but merely as the basis for the claims and as a basis for teaching one skilled in the art how to make and/or use the invention. In addition, while the present grip technology was developed with the needs of golfers in mind, the present grip technology may be used with other hand implements such as tennis racquets, baseball bats, hand tools, power tools and other industrial equipment.

I claim:

1. A method for cushioning the grip of a golf club, comprising the steps of:

providing a golf club comprising an elongated shaft, the elongated shaft defining a bore therein and having a grip at a proximal end to be grasped by a user;

removing the grip from the shaft of the golf club;

placing a pneumatically actuated cushioning apparatus over the proximal end of the shaft, the pneumatically actuated cushioning apparatus comprising:

a bladder configured to surround the proximal end of the shaft along a desired length, the bladder comprising an elongated inner layer having an upper end and a lower end and an elongated outer layer also having an upper and a lower end, with the lower end of the outer layer being sealed with the lower end of the inner layer such that the bladder is defined between the inner layer and the outer layer, and a valve extending at least partially into the bore of the shaft for receiving a volume of air;

placing the golf grip over the cushioning apparatus;

inserting a nozzle of a pump into the valve of the pneumatically actuated cushioning apparatus;

operating the pump in order to inject a volume of air through the valve and into the bladder, thereby cushioning the grip of the golf club; and inserting a pointed object into the valve so as to release at least some of the air from the bladder.

2. The method of claim 1, wherein the inner layer and the outer layer each defines a thin skin.

3. The method of claim 1, wherein the pointed object is a golf tee.

4. The method of claim 1, wherein:

a proximal end of the golf club comprises a through-opening; and the step of inserting the nozzle of a pump into the valve of the pneumatically actuated cushioning apparatus comprises inserting the nozzle through the through-opening and into the valve.

5. An apparatus for cushioning the grip of a golf club, the golf club having an elongated shaft defining a distal end and a proximal end, the proximal end having a through-opening and being configured to be grasped by a user; the apparatus comprising:

an elongated bladder configured to surround the proximal end of the shaft along a desired length, the elongated bladder comprising an inner layer having an upper end and a lower end, and an outer layer also having an upper and a lower end, with the lower end of the outer layer being sealed with the lower end of the inner layer such that the bladder is defined between the inner layer and the outer layer, and wherein the outer layer receives a separate golf club grip; and a valve for receiving a volume of air from a pump and delivering it to the bladder, the valve being aligned with the through-opening in the grip and being configured to release air from the bladder when a pointed object is inserted into the valve wherein said valve extends at least partially into said through-opening of said shaft.

6. The apparatus of claim 5, wherein the inner layer and the outer layer each defines a thin skin to form a single, circumferential air cell when air is received into the bladder.

* * * * *